United States Patent [19]

Yamashita et al.

[11] 4,436,055

[45] Mar. 13, 1984

[54] DEVELOPING APPARATUS

[75] Inventors: Keitaro Yamashita, Saitama; Hiromi Kashiwagi, Kumagaya, both of Japan

[73] Assignee: Hitachi Metals, Ltd., Japan

[21] Appl. No.: 357,295

[22] Filed: Mar. 11, 1982

[30] Foreign Application Priority Data

Mar. 20, 1981 [JP] Japan ..... 56-39543
Mar. 26, 1981 [JP] Japan ..... 56-43169

[51] Int. Cl.[3] ..... G03G 15/09
[52] U.S. Cl. ..... 118/658; 355/3 DD
[58] Field of Search ..... 118/657, 658; 430/122; 355/3 DD, 14 D

[56] References Cited

U.S. PATENT DOCUMENTS 3,703,395 11/1972 Drexler et al. ..... 118/658 X
4,101,211 7/1978 Kayson ..... 355/3 DD

FOREIGN PATENT DOCUMENTS 54-151847 11/1979 Japan ..... 355/3 DD

*Primary Examiner*—John P. McIntosh
*Assistant Examiner*—Mary Beth Fennell
*Attorney, Agent, or Firm*—Antonelli, Terry & Wands

[57] ABSTRACT

A developing apparatus includes a rotatable photosensitive drum having a peripheral surface carrying an electrostatic latent image to be developed. A plurality of developing rolls are disposed in opposition to the photosensitive drum, with developing gaps being formed between the developing rolls and the drum. Each of the developing rolls is constituted by a rotatable cylindrical sleeve of a non-magnetic material and a permanent magnet, stationarily disposed within the cylindrical sleeve, having a plurality of magnetic poles formed on the peripheral surface thereof. By rotating the sleeves in the same direction, developer is transferred from one to another developing roll while forming magnetic brushes which slidably contact the drum surface at the gaps. The latent image is developed by the magnetic brushes. To assure the positive transfer of developer, the magnetic poles of the adjacent developing rolls, positioned in opposition and closest to each other, are magnetized in opposite polarities and one or both of these magnetic poles are positioned, as viewed in the rotating direction of the associated sleeves, upstream of the position at which the adjacent developing rolls come closest to each other.

4 Claims, 5 Drawing Figures

DEVELOPING APPARATUS

The present invention relates to a developing apparatus of a magnetic brush type in which electrostatic latent images are developed by using a magnetic developer.

In a magnetic brush developing process, developer powder containing a pulverized magnetic material, stored in a developer container, is magnetically attracted by a magnetic roll to be conveyed to a developing zone or region. As is well known, an image carrier member disposed close to the magnetic roll is made of, for example, a polyester sheet of high resistivity, photoconductive selenium, a layer of photoconductive cadmium sulfide dispersed in an insulating binder and covered with an insulating film, photoconductive organic materials such as polyvinylcarbazole, poly-N-vinylcarbazol and the like, or a layer of photoconductive zinc oxide dispersed in an insulating resin binder.

The developer powder is supplied onto the magnetic roll from the developer container through a gap of a predetermined size and then conveyed to the developing region or zone by the magnetic roll through rotation thereof. The developer powder forms a magnetic brush on the magnetic roll at least in the developing zone. A surface of the image carrier member is intimately swept by the magnetic brush, whereby a toner material contained in the developer adheres to the image carrier surface in a pattern corresponding to an electric pattern image carried thereon. With the term "electric pattern image", it is intended to encompass an electrostatic charge pattern, a capacitance pattern and an electrically conductive pattern. In the following description, the terms "electrostatic latent image" will be used in the comprehensive sense.

In the magnetic brush development described above, a mixture of ferro-magnetic carrier particles and toner particles has heretofore been used as the developer or developing agent. The magnetic carrier particle is formed of a core material such as, for example, iron, steel nickel, ferrite or the like, and covered with a resin, while the toner is made of a binder resin dispersed with additives such as color pigments and/or dyes and pulverized. The carrier particles and the toner particles are frictionally charged with opposite polarities by mixing. In a normal development, the materials for the carrier particles and the toner particles are so selected that electric charge of the polarity opposite to that of the electrostatic latent image on the image carrier member is imparted to the toner particles. The developer mixture is placed in the developer container in the state in which the toner particles adhere to the surfaces of the carrier particles under the action of the frictional charge and then conveyed onto the surface of the rotating magnet roll. The developer mixture conveyed to the developing region forms the magentic brush which intimately sweeps the latent image on the image carrier member, whereby the toner particles adhere to the latent image under electrostatic attraction between the electric charge of the latent image and the charge of toner particles. However, the carrier particles remains on the magnet roll under magnetic attraction between the carrier particles and the magnetic roll. After the development, the developer mixture which is consumed in respect of the toner content is fed back to the developer container for recovery and supplemented with fresh toner.

An apparatus for carrying out the magnetic brush development described above is disclosed, for example, in U.S. Pat. Nos. 4,228,518, 4,240,375, and 4,261,290.

By the way, in, for example, electronic copying machines, printers and the like, attempts have beem made to employ the magnetic brush developing process of the type mentioned above at a higher speed with improved performances. In a developing apparatus in which the single magnet roll is used, a problem encountered is that the supply of developer to the developing zone becomes insufficient thereby eventually resulting in a degradation in the quality of copies obtained. As an approach to solve the noted problem and meet the requirement of high speed operation, a developing apparatus has been developed in which a plurality of developing magnet rolls are disposed in opposition to the image carrier surface and rotated in synchronism, to thereby transport the developer in a belt-like contiguous form over the plurality of magnet rolls so that the development is effected a corresponding number of times. Typical examples of this type developing apparatus are disclosed in, for example, U.S. Pat. Nos. 3,697,050, 4,282,827, and Offenlegungsschrift No. 2800510. However, in these prior art developing apparatus, difficulty is encountered both in the conveying developer in a uniform flow and the transferring of developer from one to another magnetic roll because of magnetic interference between the magentic rolls and other disturbance factors, resulting in failure and uneveness in feeding the developer to the developing zones or regions. Consequently, there arises a non-uniformity in the density of copied image as well as slippage and spattering of the developer at the transfer regions.

An object of the present invention is to eliminate the disadvantages of the hitherto known apparatus and provide a developing apparatus which can assure the transferring of developer between the adjacent magnetic rolls in a satisfactory manner.

Another object of the present invention is to provide a developing apparatus which is capable of producing copies of a high quality.

In view of the above objects, there is provided according to features of the invention a developing apparatus which comprises an image carrier member carrying an electrostatic latent image on a surface thereof; a plurality of developing rolls disposed in opposition to the image carrier member with developing gaps being formed therebetween, with each of the developing rolls being composed of a rotatable cylindrical sleeve made of a non-magnetic material and a permanent magnet member disposed stationarily within the sleeve and having a plurality of magnetic poles formed in the peripheral surface, wherein at least one of the magnetic poles of each of the permanent magnet members is disposed in opposition to the associated one of the developing gaps so that magnetic brushes are formed on the surfaces of the sleeves at the developing gaps when a magnetic developer is transferred between the adjacent sleeves upon rotation of the sleeves in a same direction, the image carrier member being frictionally swept by the magnetic brushes; a developer container for supplying the magnetic developer to the developing rolls; a doctor blade member for controlling a quality of the magnetic developer supplied to the developing gaps; and a scraper member for scraping off the magnetic developer after having passed through the developing gaps; wherein the magnetic poles of the adjacent developing rolls which are positioned in opposition and closest to each other are magnetized in polarities opposite to each other, and one or both of the oppositely positioned magnetic poles are displaced in the direction opposite to the rotating direction of the associated sleeve from a position at which the adjacent developing rolls come closest to each other.

These and other objects, features and advantages of the present invention will be more apparent from the following description of the preferred but non-limiting embodiments taken in conjunction with the accompanying drawings, in which.

Figure 1:
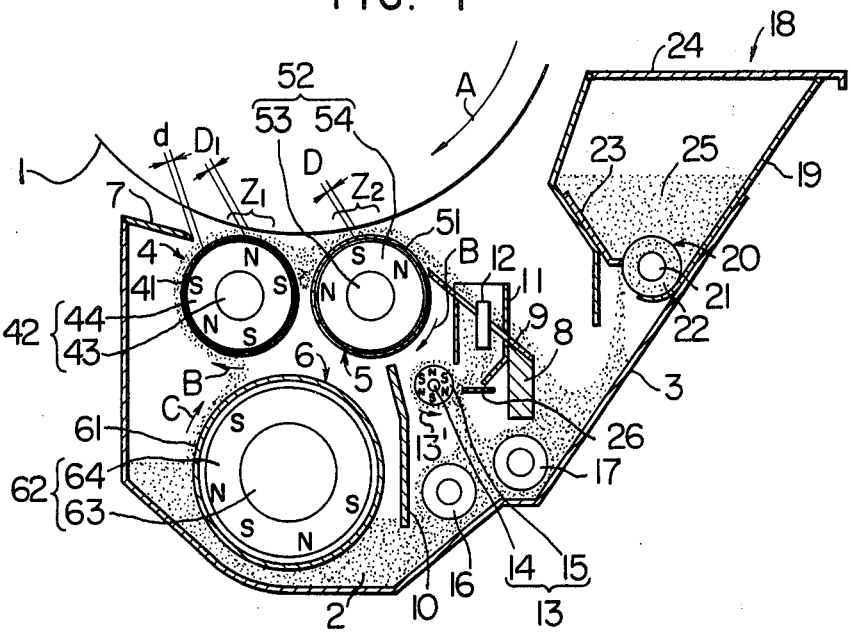
FIG. 1 is a cross sectional view a developing apparatus according to an exemplary embodiment of the present invention.

Referring now to the drawings wherein like reference numerals are used throughout the various views to designate like parts and, more particularly, to to FIG. 1, according to this figure, in a developing apparatus a mass of developing agent or developer 2, composed of magnetic carrier and toner is contained in a developer container 3. Developing magnetic rolls generally designated by the reference numerals 4 and 5, hereinafter referred to simply as the developing rolls, are disposed over the developer container 3, with the rolls 4, 5 respectively defining developing zones or regions $Z_1$ and $Z_2$ in cooperation with a photosensitive drum 1 disposed in opposition to both the developing rolls 4 and 5 and adapted to be rotated in the direction indicated by an arrow A. The developing roll 4 is constituted by a rotatable cylindrical sleeve 41 made of a non-magnetic material and a permanent magnet member 42 disposed stationarily within the sleeve 41. The permanent magnet member 42 is composed of a shaft 43 positioned coaxially with the sleeve 41 and a cylindrical permanent magnet 44 fixedly mounted on and around the shaft 43 and having a plurality of magnetic poles distributed along the outer peripheral surface thereof. In a similar manner, the developing roll 5 is constituted by a rotatable cylindrical sleeve 51 and a permanent magnet member 52 disposed stationarily within the sleeve 51. The permanent magnet member 52, in turn, is composed of a shaft 53 positioned coaxially with the sleeve 51 and a cylindrical permanent magnet 54 fixedly mounted on the shaft 53 and having a plurality of magnetic poles distributed along the outer peripheral surface thereof. In both the developing rolls 4 and 5, the sleeves 41 and 51 are adapted to be rotated around the respective permanent magnet members 42 and 52 in the direction indicated by the arrows B.

A conveying magnet roll generally designated by the reference numeral 6 hereinafter referred to simply as the conveying roll, is disposed below the developing rolls 4, 5 and serves to feed the developer 2 from the bottom portion of the developer container 3 to the developing roll 4. The conveyer roll 6 is constituted by a rotatable sleeve 61 made of a non-magnetic material and a permanent magnet member 62 mounted stationarily within the rotatable sleeve 61. The permanent magnet member 62, in turn, is composed of a shaft 63 disposed coaxially with the sleeve 61 and a cylindrical permanent magnet 64 fixedly mounted on the shaft 63 and having a plurality of magnetic poles formed on the outer peripheral surface thereof.

A doctor blade member 7 is disposed upstream of the developing zone or region $Z_1$ and is mounted on the developer container 3, with the blade member 7 serving for restricting the layer thickness of the developer 2 conveyed to the developing region $Z_1$. On the other hand, a scraper member 9 is disposed downstream of the developing region $Z_2$, with a free edge thereof being positioned in close vicinity of the developing roll 5 for scraping off the developer 2 into the developer container 3 after development. The scraper member 9 has a lower end supported on a stay or support 8 which is fixedly mounted on the inside of the container 3. A pair of rotating screws 16 and 17 are disposed below the scraper member 9 in such a manner that toner 25 supplied from a toner supplementing container generally designated by the reference numeral 18, disposed above the developer container 3, is mixed and agitated with the developer 3 scraped off by the scraper member 9 under action of the rotating screws 16 and 17 and subsequently fed to the conveying roll 6 through a gap passage formed bwtween a partition wall 10 and the bottom of the developer container 3.

The toner supplementing container 18 comprises a rotatably mounted toner supplementing roll generally designated by the reference numeral 20, disposed at an open bottom of a container case 19, and a pivotally mounted cover plate 24. The toner supplementing roll 20 is composed of a resilient member 22 formed of a porous material such as, for example, a sponge or the like, fixedly secured around a shaft 21. A plate member 23, having a bent lower end, is fixedly mounted on the inside of the toner container chamber 19 at a position such that the free end of the bent end portion of the plate member 23 presses lightly against the surface of the toner supplementing roll 20 so that the toner 25 is discharged out of the toner container 19 under action of the rotation of the toner supplementing roll 20.

A chute 11 in which a toner concentration sensor 12 is disposed is provided at an intermediate portion of the scraper member 9. With this arrangement, a portion of the developer 3 introduced onto the scraper member 9 falls in and through the chute 11, whereby content of the toner contained in the falling developer 2 can be measured by the sensor 12. On the basis of the result of the measurement, the rotational speed of the toner supplementing roll 20 can be controlled to thereby regulate the concentration of toner. In this connection, it should be mentioned that the chute 11 may be located at a substantially central position in the longitudinal direction of the developing machine having, for example, a width of 50 mm. Further, with a view to maintaining a constant density of the developer falling through the chute 11, a magnetic roll 13, constituted by a cylindrical permanent magnet 15 fixedly mounted on a shaft 14 and having six magnetic poles in a symmetric array, is disposed below the chute 11. The developer attracted onto the surface of the magnetic roll 13 is displaced through the rotation of the roll 13 in the direction indicated by the arrow 13' and scraped off by a regulating plate 26. The length of the roll 13 may be selected to be substantially equal to the width of the chute 11.

Figure 3:
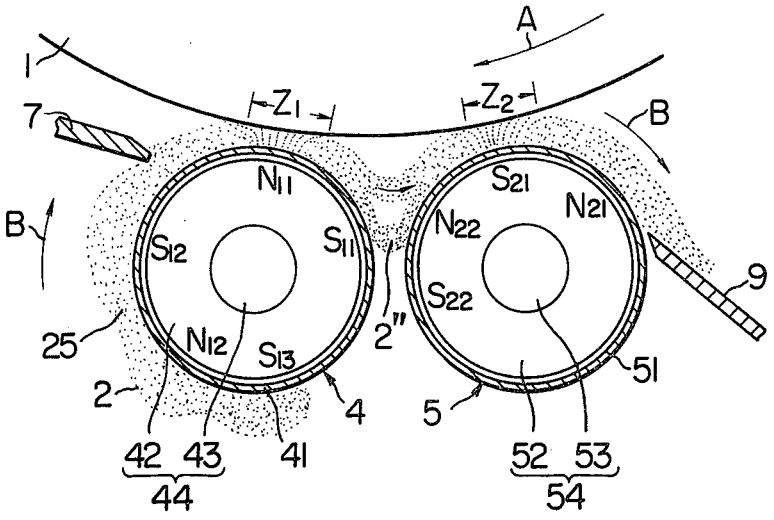
FIG. 3 PRIOR ART
FIG. 3 is a cross sectional view an arrangement of magnetic poles in a previously known developing apparatus.

In most known developing apparatus of the structure described above, there has been adopted an arrangement of magnetic poles shown in FIG. 3, wherein the development is carried out in a manner described below. The developer 2 deposited on the outer peripheral surface of the sleeve 41 of the developing roll 4 is conveyed to the developing zone or region $Z_1$ through rotation of the sleeve 41 in the direction indicated by the arrow B under the conveying action of the magnetic poles $S_{13}$, $N_{12}$ and $S_{12}$ after having been regulated in thickness by means of the doctor blade member 7. In the developing area or region $Z_1$, a magnetic brush is formed under the action of the developing magnetic pole $N_{11}$. In this situation, the cylindrical surface of the drum 1 is intimately swept by the magnetic brush, as the result of which the toner particles contained in the developer 2 are caused to adhere to the drum surface in a pattern corresponding to that of an electrostatic latent image produced on the drum surface to thereby develop the latent image. Since the drum 1 is rotated in the direction indicated by the arrow A, a first development process takes place under the action of the developing roll 5. More specifically, the first development is carried out by the magnetic brush formed on the developing magnetic pole $S_{21}$, while a second development is performed by means of the developing roll 4. The developer 2 which has passed through the developing region or area $Z_1$ is caused to follow a curved path in the form of a laminar flow as shown in FIG. 3 under the action of the magnetic coupling of the transfer portion, i.e. the actions of the magnetic fields produced by the transfer portion constituted mainly by the magnetic poles $S_{11}$, $N_{11}$, $S_{21}$, $N_{22}$ and $S_{22}$ and is transferred onto the developing roll 5. In this connection, it is noted that although the magnetic force of the receiving magnetic pole $N_{22}$ is increased by additionally providing an auxiliary magnetic pole $S_{22}$, no measure is taken as to the magnetic field of the transfer protion. Consequently, a number of problems arise. In the first place, due to complicated relationship of the magnetic forces, as indicated at 21, the developer becomes stationary or clogged between the oppositely disposed transfer magnetic poles $S_{11}$ and $N_{22}$. Additionally magnetic brush formed on the developing magnetic pole $S_{21}$ is likely to be rough and the developer 2 tends to spatter at the transfer portion.

Figure 2:
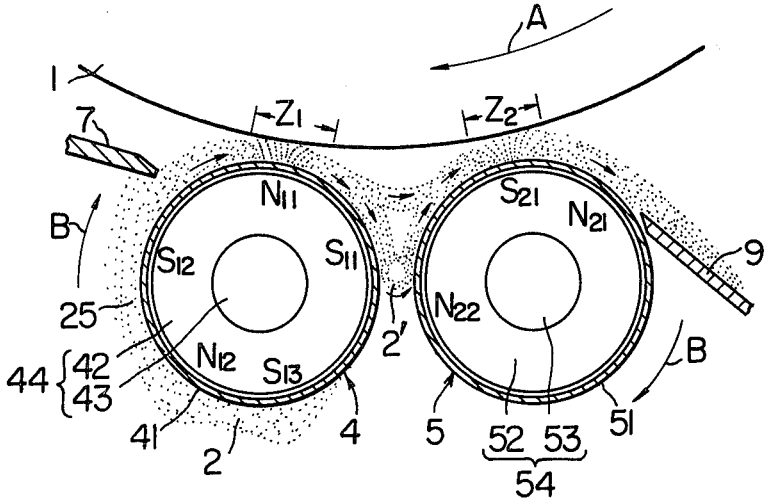
FIG. 2 is a partial cross-sectional view, on an enlarged scale, main portion of the developing apparatus shown in FIG. 1.

After numerous experimental studies, it was discovered that a magnetic pole array as shown in FIG. 2 brings about satisfactory results. Referring to FIG. 2, it will be seen that the transfer magnetic pole $S_{11}$ of the developing roll 4 which is located in the closest opposition to the magnetic pole $N_{22}$ of the other developing roll 5 is displaced upwardly to the side upstream of the magnetic pole $N_{22}$, as viewed in the rotating direction of the sleeve 41, so that the transfer magnetic pole $S_{11}$ is located slightly nearer to the developing magnetic pole $N_{11}$, whereby the magnetic coupling of a correspondingly inclined direction is produced between the magentic pole $S_{11}$ and the magnetic pole $N_{22}$.

With the arrangement of the magnetic poles described above, the developer is prevented from becoming stationary between the magnetic poles $S_{11}$ and the magnetic pole $N_{22}$ as indicated at 2″ in FIG. 3 and that vortex-like motion of the direction opposite to the rotating direction of the sleeve 41 is imparted to the developer as indicated by 2′ in FIG. 2. Consequently, the flow of developer 2 transferred from the developing roll 4 to the developing roll 5 is divided into two streams after having passed over the magnetic pole $N_{11}$. Namely, first developer streams follows a short flow path located above the developer 2′ put into the vortex motion mentioned above to be thereby transferred to the developing roll 5, while the second stream of the developer once undergoing the vortex motion at 2′ and is then transferred onto the developing roll 5. Finally, the two streams of the developer meet at a region in front of the magnetic pole $S_{21}$, as can be seen from FIG. 2. In this manner, the time required for the developer 2 to be transferred to the developing roll 5 differs from the first to the second developer streams, which is very advantageous for attaining a uniform mixing of the toner and carrier particles. When compared with the arrangement in which only the single flow path of the developer is produced as in the case of the arrangement shown in FIG. 3, the first stream of the developer following the short flow path is a stable laminar flow which scarcely undergoes spattering. Further, the magnetic brush formed by the developing roll 5 is as uniform and dense as the magnetic brush formed by the developing roll 4.

It is believed that generation of the vortex-like motion of the developer as indicated by 2′ in the magnetic pole arrangement shown in FIG. 2 may be explained by the fact that the flow of the magnetic flux at the transfer portion between the developing rolls 4 and 5 disposed in opposition to each other is not symmetrical with respect to the shortest distance between these rolls 4 and 5 by inclined relative to the axis of the shortest distance or gap and that the distance or gap between the transferring magnetic pole $S_{11}$ of the developing roll 4 and the receiving magnetic pole $N_{22}$ of the developing roll 6 is upwardly enlarged or flared so that there is a feeble mutual magnetic interference between these magnetic poles $S_{11}$ and $N_{22}$. In the case of the known magnetic pole arrangement shown in FIG. 3, a large amount of the developer is fed to the transfer portion, whereby slippage occurs between the mass of developer and the sleeves, giving rise to the stationary state of the developer as indicated at 2″ in FIG. 3. In contrast, in the case of the magnetic pole arrangement according to the present invention, a torque, due to friction between the developer and the sleeves produced under the influence of the inclined magnetic field, will effectively act on the developer located between the sleeves to thereby move the developer in the direction to be transferred onto the developing roll 5. In this connection, it should be noted that, when the magnetic pole $S_{11}$ of the transferring roll 4 is disposed on the side downstream of the associated receiving magnetic pole $N_{22}$ of the roll 5, i.e. at a position remote from the developing magnetic pole $N_{11}$ so that the magnetic field, inclined in the direction opposite to that of the magnetic field, is produced in the magnetic pole arrangement shown in FIG. 2, the rotational torque mentioned above does not appear at all, resulting in the developer, becomming stationary at the transfer portion, with the magnetic brush formed on the developing roll 5 being roughed as is in the case of the magnetic pole arrangement shown in FIG. 3. Further, with the arrangement of the developer receiving magnetic pole $N_{22}$ of the developing roll 5 located on the side downstream of the developer transferring pole $S_{11}$, i.e. at a position near to the developing magnetic pole, it has been observed that the magnetic brush becomes rough.

After further experiments, it has been found that, in the magnetic pole arrangement shown in FIG. 2, the magnetic brush can be formed in a more satisfactory manner by increasing the peripheral speed of the sleeve 51 of the developer receiving developing roll 5 up to about twice as high as the peripheral speed of the sleeve of the developing roll 4 located on the transferring side.

In the case of the developing apparatus shown in FIG. 2, the developer is scraped down from the sleeve 51 primarily under gravity by means of the scraper 9 after the development. According to another embodiment of the invention, such scraping operation can be further improved by adopting a structure illustrated in FIG. 4 wherein, an auxiliary magnetic pole $S_{23}$ of a relatively low strength and magnetic polarity opposite to that of the magnetic pole $N_{21}$ is provided below the scraper 9, with the auxiliary magnetic pole $S_{23}$ being so disposed that the direction of the magnetic flux (or magnetic line of force) at the free edge of the scraper 9 lies substantially in a plane of the upper surface of the scraper 9. With this arrangement, the magnetic force will cooperates with the action of gravity to more effectively scrape off the developer.

Figure 5:
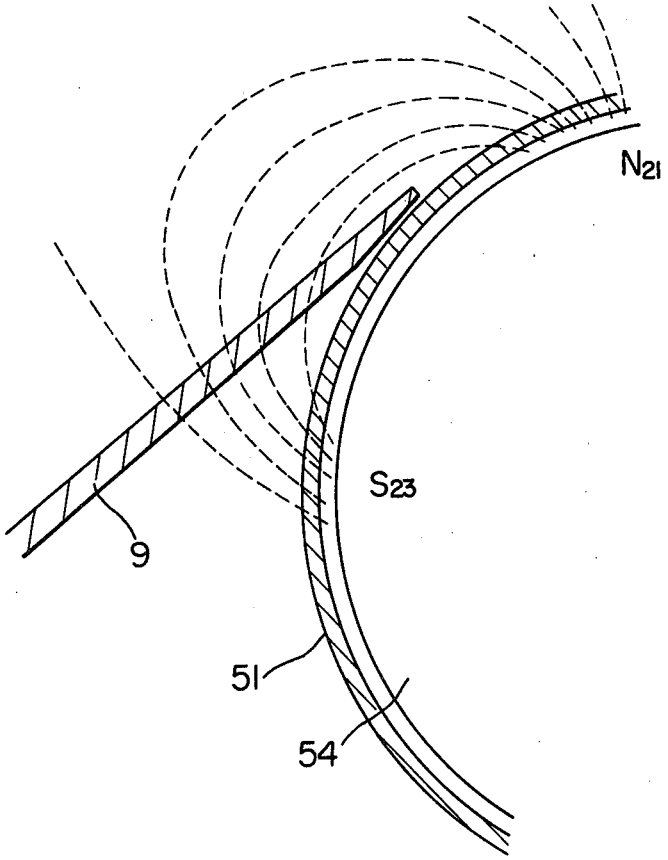
FIG. 5 is a cross sectional view, on an enlarged scale, of a main portion of the developing apparatus shown in FIG. 4.

More specifically, as shown in FIG. 5, when the magnetic pole $S_{23}$ of a polarity opposite to that of the magnetic pole $N_{21}$ is disposed below the scraper 9, so disposed that the direction of the magnetic line of force at the free edge of the scraper 9 substantially coincides with the plane of the upper surface of the scraper 9, i.e. the direction in which the developer is scraped off, as described above, the developer particles which are contiguous in a chain-like form in the direction of the magnetic line of force (not shown in FIG. 5) can get on the upper surface of the scraper 9 without any difficulty and be scaped off from the sleeve 51 very effectively under a pushing force exerted by the contiguously succeeding developer on the sleeve 51 in addition to the influence of gravity. In this case, the auxiliary magnetic pole $S_{23}$ should be of a smaller strength than the magnetic pole $N_{21}$ to assure more effective scraping fucntion. Experimental results have shown that the strength of the magnetic pole $S_{23}$ should preferably be in a range of 5 to 60% of the strength of the magnetic pole $N_{21}$. When the strength of the magnetic pole $S_{23}$ is decreased below 5% of the strength of the magnetic pole $N_{21}$, the scraping is effected only under the action of gravity, eventually resulting in that the developer particles being stacked at the free edge portion of the scraper 9. On the other hand, when the strength of the magnetic pole $S_{23}$ is increased beyond 60% of the strength of the magnetic pole $N_{21}$, the magnetic force component of the direction perpendicular to the upper surface of the scraper 9 is increased at a region slightly spaced from the free edge of the scraper 9, whereby the developer particles are likely to be stacked at this region.

Figure 4:
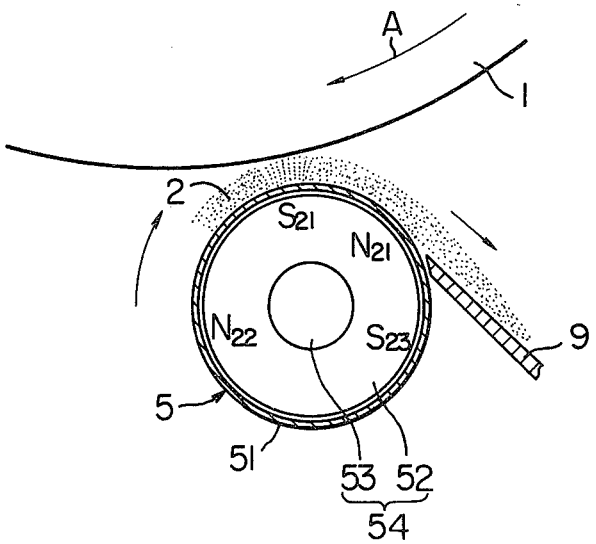
FIG. 4 is a cross sectional view of another exemplary embodiment of the developing apparatus according to the invention.

By the way, it has also be found that disposition of a ferromagnetic body in place of the magnetic pole $S_{23}$ in the arrangement shown in FIG. 4 brings about similar advantageous action and effect.

EXAMPLE 1

Referring to FIGS. 1 and 2, each of the sleeves 41 and 51 was constituted by a cylinder of stainless steel having an outer diameter of 40 mm. The gap between the sleeves 41 and 51 at the closest location was selected to be equal to 6 mm. Each of the permanent magnets 44 and 54 was constituted by a barium ferrite magnet having an outer diameter of 36 mm. The strength of the magnetic pole $N_{11}$ (the value as measured on the sleeve: same applies to the strengths of the magnetic poles mentioned below) was selected to be 900 gauss. The strength of the magnetic pole $S_{12}$ was 650 gauss. The angle formed between the magnetic poles $N_{11}$ and $S_{12}$ was 60°. In the developing roll 5, the strength of the magnetic pole $S_{21}$ was 850 gauss with that of the magnetic pole $N_{22}$ being 650 gauss. The angle formed between the magnetic poles $S_{21}$ and $N_{22}$ was selected equal to 90°. The sleeves 41 and 51 were rotated at a speed of 200 r.p.m. A doctor gap d (FIG. 1) was set at 4 mm with both developing gaps $D_1$ and $D_2$ being set at 4 mm. Toner concentration of the developer was controlled so as to be 4%. On these conditions, development was carried out.

It was observed that a vortex of developer rotating at a high speed is produced at the transfer location 2'', resulting in about $\frac{1}{3}$ of the developer 2, transferred from the sleeve 41, flowing into the vortex while the remaining part (about $\frac{2}{3}$) of the developer 2 being transferred along the curved path located above the vortex, whereby the transfer of the developer is effected in a stabilized manner, and substantially identical magnetic brushes of an improved quality are formed on both of the developing rolls 4 and 5. In this connection, the photo-sensitive drum 1 made of selenium and having a diameter of 120 mm was rotated at a peripheral speed of 500 mm/sec and 50,000 sheets of copies were successively produced. Images were reproduced with a copy density higher than 1.2 and a resolution of 8.3 lines/mm.

When the sleeve 51 of the developing roll 5 was rotated at a speed in a range of 220 to 260 r.p.m. with the rotational speed of the sleeve 41 of the developing roll 4 being fixed at the value mentioned above, a magnetic brush of a higher quality was formed on the developing roll 5, which allowed picture elements of half tone to be reproduced very satisfactorily, with fog density signficantly decreased.

The developer used in this example was a mixture of iron powder having a mean particle size of 100 μm and toner having a mean particle size of 15 μm.

EXAMPLE 2

Development was conducted on the same conditions as those of the Example 1 except that the developing roll 5 of the structure shown in FIG. 4 was employed. The angle formed between the magnetic poles $N_{21}$ and $S_{23}$ was 60° and an angle of inclination of the scraper 9 relative to the horizontal was selected to be 45°. After experiments effected by varying the strength of the magnetic pole $S_{23}$ and the position of the free edge of the scraper 9, it was found that very satisfactory scraping of developer could be realized with the strength of the magnetic pole $S_{23}$ in the range of 50 to 500 gauss while the free edge of the scraper 9 was positioned closer to the magnetic pole $S_{23}$ by an angular distance of 15° to 40° from the center of the magnetic pole $N_{21}$.

In the foregoing description, it has been assumed that the number of the developing rolls employed was two. However, the invention is not restricted to only two developing rolls but can also be applied to the developing apparatus where three or more developing rolls are used. Further, the number of the magnetic poles is a matter determined in consideration of the size and the position of the developing roll as well as the conditions of development. Besides, the permanent magnet is not restricted to the cylindrical shape but may be in the form of a block or sector in the cross-section. Finally, the developer is not restricted to that of the two-component series. A magnetic toner of one-component series can also be equally employed.

It will not be appreciated that the invention has proposed a developing apparatus in which transfer of the developing agent or developer between two adjacent magnetic rolls can take place in a desirable manner and which assures reproduction of images of high quality. Further, the scraping-off of the developer in succession to the developing process can be realized very effectively.

What is claimed is:

1. A developing apparatus comprising an image carrier member carrying an electrostatic latent image on a surface thereof; a plurality of developing rolls disposed in opposition to said image carrier member with developing gaps being formed therebetween, each of said developing rolls being formed therebetween, each of said developing rolls being composed of a rotatable cylindrical sleeve made of a non-magnetic material and a permanent magnet member disposed stationarily within said sleeve and having a plurality of magnetic poles formed in the peripheral surface, wherein at least one of said magnetic poles of each of said permanent magnet members is disposed in opposition to the associated one of said developing gaps so that magnetic brushes are formed on the surfaces of the sleeves at said developing gaps when a magnetic developer is transferred between the adjacent sleeves upon rotation of said sleeves in a same direction, said image carrier member being frictionally swept by said magnetic brushes; a developer container for supplying said magnetic developer to said developing rolls; a doctor blade member for controlling a quantity of said magnetic developer supplied to said developing gaps; and a scraper member for scraping off the magnetic developer after having passed through said developing gaps; wherein the magnetic poles of the adjacent developing rolls which are positioned in opposition and closest to each other are magnetized in polarities opposite to each other, and the magnetic pole on a magnetic developer receiving side of said oppositely positioned magnetic poles is displaced in a direction opposite to the rotating direction of the associated sleeve from a position at which said adjacent developing rolls come closest to each other thereby producing a magnetic coupling having a direction which is inclined between said oppositely positioned magnetic poles.

2. A developing apparatus according to claim 1, further comprising means for driving the sleeve which receives the magnetic developer at a peripheral speed of up to twice a peripheral speed of the sleeve which transfers the magnetic developer.

3. A developing apparatus according to claim 1, further including an additional magnetic pole disposed below said scraper member, wherein said scraper member is so disposed that the upper surface of a free edge portion of said scraper member extends substantially in parallel with a direction of a magnetic line of force produced by said permanent magnet member.

4. A developing apparatus comprising an image carrier member carrying an electrostatic latent image on a surface thereof; a plurality of developing rolls disposed in opposition to said image carrier member with developing gaps being formed therebetween, each of said developing rolls being composed of a rotatable cylindrical sleeve made of a non-magnetic material and a permanent magnet member disposed stationarily within said sleeve and having a plurality of magnetic poles formed in the peripheral surface, wherein at least one of said magnetic poles of each of said permanent magnet members is disposed in opposition to the associated one of said developing gaps so that magnetic brushes are formed on the surfaces of said sleeves at said developing gaps when a magnetic developer is transferred between the adjacent sleeves upon rotation of said sleeves in a same direction, said image carrier member being frictionally swept by said magnetic brushes; a developer container for supplying said magnetic developer to said developing rolls; a doctor blade member for controlling a quantity of said magnetic developer supplied to said developing gaps; and a scraper member for scraping off the magnetic developer after having passed through said developing gaps; wherein the magnetic poles of the adjacent developing rolls which are positioned in oppostion and closest to each other are magnetized in polarities opposite to each other, and at least one of said oppositely positioned magnetic poles are displaced in the direction opposite to the rotating direction of the associated sleeve from a position at which said adjacent developing rolls come closest to each otheer, and additional magnetic pole disposed below said scraper member, sid scraper member is disposed so that the upper surface of a free edge portion of said scraper member extends substantially parallel with a directon of a magnetic line of force produced by said permanent magnet member, said additional magnetic pole disposed below said scraper member is a relatively feeble strength corresponding to 5% to 60% of that of the magnetic pole located adjacent to an upstream of said scraper member as viewed in the rotating direction of said sleeve.

* * * * *